United States Patent [19]

Stack et al.

[11] Patent Number: 4,939,200

[45] Date of Patent: Jul. 3, 1990

[54] FAST CURING BINDER FOR CELLULOSE

[75] Inventors: Dennis P. Stack, Santa Ana; Paul J. Steinwand, Placentia, both of Calif.

[73] Assignee: Union Oil Company of California, Brea, Calif.

[21] Appl. No.: 149,396

[22] Filed: Jan. 28, 1988

[51] Int. Cl.[5] ..... C08L 33/26; C08L 33/24; C08L 33/02; C09J 133/24

[52] U.S. Cl. ..... 524/501; 525/218; 525/221

[58] Field of Search ..... 525/218, 221, 193; 524/501

[56] References Cited

U.S. PATENT DOCUMENTS

| | | | |
|---|---|---|---|
| 3,594,337 | 7/1971 | Shea | 525/218 |
| 3,616,166 | 10/1971 | Kelley | 525/218 |
| 4,406,660 | 9/1983 | Beiner | 526/318.25 |
| 4,455,342 | 6/1984 | Fink | 524/555 |
| 4,554,337 | 11/1985 | Krinski | 527/201 |
| 4,743,498 | 5/1988 | Kedrowski | 428/288 |

FOREIGN PATENT DOCUMENTS

| | | | |
|---|---|---|---|
| 224736 | 6/1987 | European Pat. Off. . | |
| 090870 | 7/1981 | Japan | 524/501 |
| 160634 | 10/1982 | Japan . | |

*Primary Examiner*—John C. Bleutge
*Assistant Examiner*—David Buttner
*Attorney, Agent, or Firm*—Gregory F. Wirzbicki; Arthur E. Oaks; Michael A. Kondzella

[57] ABSTRACT

Non-formaldehyde emitting binders for nonwoven cellulosic materials comprise a solution copolymer of an olefinically unsaturated organic compound having at least one carboxylate group, which is reacted with a primary or secondary amide of an olefinically unsaturated carboxylic acid. The produce of said reaction is admixed with a non-formaldehyde containing latex carrier which has been formulated with a non-formaldehyde forming reactive monomer to produce binder compositions which reach substantially fully cured wet strength in 8 seconds or less.

16 Claims, No Drawings

FAST CURING BINDER FOR CELLULOSE

FIELD OF THE INVENTION

The invention relates to polymeric binders for cellulose and more particularly to fast curing compositions based on a solution polymerized copolymer system admixed with a polymeric carrier latex which is especially useful where low formaldehyde emitting applications are involved.

BACKGROUND OF THE INVENTION

During the past few years there has been a substantial growth in the production of high-strength paper and cloth products having a nonwoven, randomly-oriented structure, bonded with a polymeric resin binder. Such products are finding wide use as high-strength, high-absorbency materials for disposable items such as consumer and industrial wipes/towels, diapers, surgical packs and gowns, industrial work clothing and feminine hygiene products. They are also used for durable products such as carpet and rug backings, apparel interlinings, automotive components and home furnishings, and for civil engineering materials such as road underlays. There are several ways to apply such a binder to these materials, including spraying, print binding, and foam application. Further, depending on the end use, various ingredients such as catalysts, cross-linkers, surfactants, thickeners, dyes, and flame retardant salts may also be incorporated into the binder system.

In the high-speed, high-volume manufacture of cellulosic products such as wet wipes, an important binder property is a fast cure rate; i.e., the finished product must reach substantially full tensile strength in a very short time after binder application so that production rates are not unduly slowed down. In these products, such a property is usually obtained by using a binder which is either self cross-linkable or by incorporating an external cross-linker into the binder formulation. When this is done, the cross-linker apparently not only interacts with the binder monomers but with the hydroxyl groups on the cellulose fibers to quickly form very strong bonds.

At present, there are a number of available binder formulations which meet this requirement. However, these materials are typified by incorporating one or more constituents which, over some period of time, will emit formaldehyde in amounts which may be sufficient to cause skin and respiratory irritation in many people, particularly children. Most recently, several of the leading manufacturers of nonwoven cellulosic products have expressed a desire to replace such binders with products offering equivalent levels of performance in cellulose but without the emission of formaldehyde. Although a number of ostensibly zero formaldehyde or "0 $CH_2O$" cellulose binders have been proposed, they have either not been truly "0" in formaldehyde content or have not shown sufficiently fast cure rates to be acceptable in high-volume production applications.

BRIEF DESCRIPTION OF THE INVENTION

In accordance with the present invention, fast curing, "zero" formaldehyde binders for nonwoven cellulosic materials are provided. These binders comprise a solution copolymer formed by reacting an aqueous mixture comprising a first comonomer selected from one or more water soluble olefinically unsaturated organic compounds having at least one carboxylate group therein and a second water-soluble comonomer selected from one or more olefinically unsaturated amides, said copolymer solution being admixed with a latex which emits little or no formaldehyde to produce a final composite binder composition which is essentially free of formaldehyde. In a second embodiment, the solution copolymer further comprises one or more olefinically unsaturated carboxylic acid hydroxyesters as a constituent thereof. When cured on nonwoven cellulosic material, the zero formaldehyde emitting binders of the present invention will achieve at least 80% of fully cured wet tensile strength in 8 seconds or less.

DETAILED DESCRIPTION OF THE INVENTION

The present invention comprises a fast-curing, zero formaldehyde binder composition for nonwoven cellulosic materials. The binder comprises a polymeric composition formed by the solution copolymerization of a mixture containing at least two water-soluble monomers. The first of these water-soluble comonomers comprises one or more organic compounds having at least one olefinically unsaturated linkage with at least one carboxylate group, said compounds having the general formula:

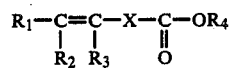

(a)

wherein $R_1$, $R_2$, and $R_3$ are independently hydrogen, halogen, nitro, amino, and organic groups; $R_4$ is hydrogen or an organic radical, usually containing no more than about 10 carbon atoms; and X is a covalent bond or an organic radical, usually of no more than about 10 carbon atoms. Normally, the number of all the carbon atoms in compound (a) is no greater than 30.

This first comonomer is reacted with a second water-soluble comonomer comprised of one or more compounds having the general formula:

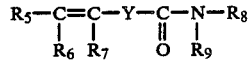

(b)

wherein $R_5$, $R_6$, and $R_7$ are independently selected from nitro, hydrogen, halogen, amino, and organic radicals; $R_8$ and $R_9$ are hydrogen or organic radicals, preferably having no more than 6 carbon atoms; and Y is a covalent bond or an organic radical, usually of no more than about 10 carbon atoms.

In a second embodiment of this invention, the solution polymer further comprises one or more third water-soluble compounds having the general formula:

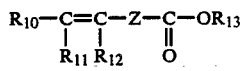

(c)

wherein $R_{10}$, $R_{11}$, and $R_{12}$ are independently selected from hydrogen, halogen, nitro, amino, and organic radicals, usually of no more than 10 carbon atoms; $R_{13}$ is an organic radical having at least 2, and usually no more than 10, carbon atoms, with at least one of $R_{10}$, $R_{11}$, $R_{12}$, and $R_{13}$ being an organic radical having a hydroxyl substituent thereon, said hydroxyl substituent being at least 2 carbon atoms away from the carboxylate group.

Where one or more of $R_{10}$, $R_{11}$, and $R_{12}$ are organic radicals having a hydroxyl substituent, $R_{13}$ is preferably an unsubstituted hydrocarbon radical, usually of no more than 10 carbon atoms. Z is a covalent bond or an organic radical, usually of no more than about 10 carbon atoms.

The term "organic" radical, when used herein, broadly refers to any carbon-containing radical. Such branched chains, and can contain one or more hetero atoms such as sulfur, nitrogen, oxygen, phosphorus, and the like. Further, they may be substituted with one or more substituents such as thio, hydroxy, nitro, amino, nitrile, carboxyl and halogen. In addition to aliphatic chains, such radicals may contain aryl groups, including arylalkyl and alkylaryl groups, and cycloalkyl groups, including alkyl-substituted cycloalkyl and cycloalkyl-substituted alkyl groups, with such groups, if desired, being substituted with any of the substituents listed herein above. When cyclic groups are present, whether aromatic or nonaromatic, it is preferred that they have only one ring. The term "water soluble" shall denote a solubility in an amount of at least 2.5%, by weight, at a temperature of about 90° C. in deionized water. Preferably the comonomers are soluble in water to the extent of at least 5%, and most preferably at least 15%, by weight.

Preferred organic radicals for compounds (a), (b), and (c) are, in general, free of olefinic and alkynyl linkages and also free of aromatic groups. In compound (a), it is further preferred that $R_1$, $R_2$, and $R_3$ be hydrogen or unsubstituted cycloalkyl or unsubstituted, straight or branched alkyl groups which have no more than 7 carbon atoms, with the exception that at least one of $R_1$, $R_2$, and $R_3$ may either be or bear a nitrile or a carboxylate $$(-\underset{\underset{O}{\|}}{C}-OR_{14})\ \text{group},$$

wherein $R_{14}$ is hydrogen or an organic radical, usually having no more that about 10 carbon atoms. More preferably, $R_1$, $R_2$, and $R_3$, except for the group or groups being or bearing the nitrile or carboxylate group, are hydrogen or unsubstituted, straight or branched chain alkyl groups having no more than 5 carbon atoms. When X is an organic radical, it preferably has no more than 6 carbon atoms and is an unsubstituted, branched or unbranched alkyl or unsubstituted cycloalkyl radical and, when an alkyl group, is most preferably unbranched.

In the most preferred form of all, compound (a) is a dicarboxylic acid wherein $R_1$, $R_2$, and $R_3$ are all independently hydrogen, carboxylate groups, or ethyl or methyl groups, either unsubstituted or substituted with a carboxylate group, provided that $R_1$, $R_2$, and $R_3$ comprise, in total, only one carboxylate group. Most preferred for $R_4$ and $R_{14}$ are hydrogen and unsubstituted alkyl or unsubstituted cycloalkyl groups, provided at least one of $R_4$ and $R_{14}$ is hydrogen. Most preferred for X is a covalent bond.

In particular regard to the most preferred embodiment of the water-soluble comonomer of compound (a), it is still more preferred that, except for the carboxylate groups, the remainder of the compound be hydrocarbyl; i.e., consist of only carbon and hydrogen atoms, and that the maximum number of carbon atoms in the compound be 27; with $R_1$ and $R_2$ combined having no more than 9, and $R_3$ no more than 8; with $R_4$ and $R_{14}$ having no more than 7 carbon atoms, provided that at least one of $R_4$ and $R_{14}$ is hydrogen. In the very most preferred embodiment, each side of the olefinic linkage has no more than about 5 carbon atoms, at least of $R_1$, $R_2$, and $R_3$ is or contains the carboxylate $$(-\underset{\underset{O}{\|}}{C}-OR_{14})\ \text{group},$$

and both of $R_4$ and $R_{14}$ are hydrogen.

For compound (b), it is preferred that $R_5$, $R_6$, and $R_7$ be free of carboxylate substituents and, even more preferably, that they be hydrogen or unsubstituted cycloalkyl or unsubstituted, straight or branched alkyl groups which have no more than 7 carbon atoms. Most preferably, $R_5$, $R_6$, and $R_7$ are hydrogen or straight or branched, unsubstituted alkyl groups having no more than 5 carbon atoms. In the very most preferred form of all, $R_5$, $R_6$, and $R_7$, are all independently ethyl, methyl, or hydrogen. Preferred for $R_8$ and $R_9$ are hydrogen or unsubstituted, branched or unbranched, alkyl or unsubstituted cycloalkyl groups each having no more than 6 carbon atoms, provided that at least one of $R_8$ and $R_9$ is hydrogen. When Y is an organic radical, it is preferably an unsubstituted, branched or unbranched, alkyl or unbranched cycloalkyl group with no more than about 6 carbon atoms and, when an alkyl group, is more preferably unbranched. However, most preferred for Y is a covalent bond.

For compound (c), it is preferred that $R_{10}$, $R_{11}$, and $R_{12}$ be free of hydroxyl and carboxylate substituents and, even more preferably, that they be hydrogen or unsubstituted cycloalkyl or unsubstituted, straight or branched chain alkyl groups which have no more than 7 carbon atoms. Most preferably, $R_{10}$, $R_{11}$, and $R_{12}$ are hydrogen or unsubstituted, straight or branched chain alkyl groups having no more than 5 carbon atoms. In the very most preferred form of all, $R_{10}$, $R_{11}$, and $R_{12}$ are all independently ethyl, methyl, or hydrogen. $R_{13}$ is also preferably free of carboxylate groups and is most preferably an alkyl or cycloalkyl group, with the required hydroxyl group being substituted at least 2 carbon atoms away from the carboxylate group. When Z is an organic radical, it is preferably a branched or unbranched, unsubstituted alkyl or unsubstituted cycloalkyl group with no more than about 6 carbon atoms and, when an alkyl group, is preferably unbranched. However, most preferred for Z is a covalent bond.

Suitable polymerizable, water-soluble monomers for compound (a) according to the most preferred description include monoolefinically unsaturated diacids, such as tetrahydrophthalic acid, methylenesuccinic acid (itaconic acid), the cis- and trans- forms of butenedioic acid (maleic and fumaric acids), and both the cis- and trans-forms (where such exist) of the diacids resulting when one or more of the hydrogen atoms on the carbon chains of maleic/fumaric acid or itaconic acid is replaced with a methyl or ethyl group, as well as the $C_1$ to $C_{10}$ and, preferably, $C_1$ to $C_5$ semi-esters of these acids Of these, itaconic acid and maleic acid are most preferred.

Preferred polymerizable water-soluble, unsaturated compounds according to the above most preferred description for formula (b) are the primary and secondary amides of acrylic and methacrylic acid, with $R_8$ being hydrogen and R being either hydrogen, methyl, or ethyl Of the amido compounds meeting these criteria, acrylamide is most preferred.

Preferred polymerizable, water-soluble, unsaturated compounds according to the above most preferred description for compound (c) are the hydroxy alkyl and hydroxy cycloalkyl esters of acrylic and methacrylic acids, and while the esterifying moiety must have at least 2 carbon atoms, it preferably has no more than about 6, and, more preferably, no more than about 4 carbon atoms. Of the hydroxy alkyl and hyroxy cycloalkyl esters of acrylic and methacrylic acids meeting these criteria, 2-hydroxyethyl acrylate is most preferred.

The copolymerization reaction is conducted with between about 0.1 part and about 9 parts, by weight, of either compound (b) alone or each of compounds (b) and (c) together, for each part of compound (a). The fast curing binder compositions of the present invention are typically formed when between about 2% and about 20%, by weight, of an aqueous solution of the resultant solution copolymer is admixed with a polymeric carrier latex which may, in turn, have been formulated with between about 2% and about 15% of a non-formaldehyde emitting reactive monomer. Such an admixture, when cured at a suitable temperature on a matrix of nonwoven cellulosic material, will bind said material with at least 80% of fully cured wet tensile strength in 8 seconds or less.

As used herein, the terms "non-formaldehyde" and "zero formaldehyde", when used in relation to the binders of the present invention, shall be taken to mean that a free formaldehyde level of 10 ppm or less is observed in the fully cured compositions. Such a level is close to the minimum level of detectability for most analytical methods and well below the level known to cause respiratory and skin irritation problems in people. The term "fully-cured" shall mean the wet tensile strength observed after a 25-second cure time.

In the first embodiment of the present invention, a comonomeric mixture comprising between about 0.1 and about 9.0 parts, by weight, and, preferably, between about 0.3 and about 3 parts, by weight, of compound (b) to 1 part of one of the acid monomers of compound (a), particularly the dicarboxylic acid forms thereof, has been found to be particularly efficacious in producing a solution copolymer for the fast-curing binders of the present invention.

In the second embodiment of the present invention, the comonomeric mixture preferably comprises between about 0.3 and about 3.0 parts, by weight, but, more preferably, between about 0.75 and about 1.5 parts, by weight, of each of the preferred compounds for (b) and (c) to 1 part of one of the preferred dicarboxylic acid monomers of compound (a).

In addition to the basic comonomeric charge, as described above, one can also add a number of other agents to the mixture. It will be understood that any percentage values hereinafter given and in the claims for such agents are each based on the basic monomeric charge. Thus, the solution copolymeric composition may optionally contain up to about 20 weight percent of one or more polymerizable, monoolefinically unsaturated nonionic monomers to serve as extenders, $T_g$ modifiers, etc. without significantly degrading its basic properties. Suitable additive monomers for such purposes include the $C_1$ to $C_5$ saturated esters of acrylic and methacrylic acid, vinylidene chloride and vinyl compounds such as vinyl chloride, vinyl acetate, styrene, and the like. Preferred additive monomers are ethyl acrylate, butyl acrylate and styrene.

Suitable copolymers of components (a), (b), and (c) can be prepared by either thermal or, preferably, free-radical initiated solution polymerization methods. Further, the reaction may be conducted by batch, semi-batch, and continuous procedures, which are well known for use in conventional polymerization reactions. Where free-radical polymerization is used, illustrative procedures suitable for producing aqueous polymer solutions involve gradually adding the monomer or monomers to be polymerized simultaneously to an aqueous reaction medium at rates proportionate to the respective percentage of each monomer in the finished copolymer and initiating and continuing said polymerization with a suitable reaction catalyst. Optionally, one or more of the comonomers can be added disproportionately throughout the polymerization so that the polymer formed during the initial stages of polymerization will have a composition and/or a molecular weight differing from that formed during the intermediate and later stages of the same polymerization reaction.

Illustrative water-soluble, free-radical initiators are hydrogen peroxide and an alkali metal (sodium, potassium, or lithium) or ammonium persulfate, or a mixture of such an initiator in combination with a reducing agent activator, such as a sulfite, more specifically an alkali metabisulfite, hyposulfite or hydrosulfite, glucose, ascorbic acid, erythorbic acid, etc. to form a "redox" system. Normally the amount of initiator used ranges from about 0.01% to about 5%, by weight, based on the monomer charge. In a redox system, a corresponding range (about 0.01 to about 5%) of reducing agent is normally used.

The reaction, once started, is continued, with agitation, at a temperature sufficient to maintain an adequate reaction rate until most, or all, of the comonomers are consumed and until the solution reaches a polymer solids concentration between about 1% and about 50%, by weight. Normally, the solids content will be kept above 10% to minimize drying problems when the binder is applied to cellulosic materials. At this point, the solution normally will have a viscosity in the range between about 5 and about 5000 CPS. Where experience has shown that a given comonomeric mixture will form a copolymeric solution having a viscosity in excess of about 5000 CPS, between 0.1 and about 5% of a suitable chain transfer agent may also be added to the reaction mixture to produce a lower molecular weight solution copolymer having a final viscosity within the 5 to 5000 CPS range. Examples of suitable chain transfer agents are organic halides such as carbon tetrachloride and tetrabromide, alkyl mercaptans, such as secondary and tertiary butyl mercaptan, and thio substituted polyhydroxyl alcohols, such as monothioglycerine.

In the present invention, reaction temperatures in the range of about 10° C. to about 100° C. will yield satisfactory polymeric compositions. When persulfate systems are used, the solution temperature is normally in the range of 60° C. to about 100° C., while, in redox systems, the temperature is normally in the range of 10° C. to about 70° C., and preferably 30° C. to 60° C.

The binder composition of the present invention is formed when an amount of the aqueous solution copolymer comprising the reaction product of either of the embodiments described above is admixed with a fast-curing polymeric carrier latex. There are a number of commercially available zero formaldehyde latex carriers which, as basically formulated, would meet this requirement. These include styrene-butadiene resin (SBR) copolymers having between about 50% and about 70% styrene therein, carboxylated SBR copolymers (i.e., an SBR composition in which between about 0.2% and about 10% of one or more ethylenically unsaturated mono- or dicarboxylic acid monomers, such as acrylic acid, methacrylic acid, itaconic acid, maleic acid or fumaric acid, is copolymerized therewith), vinyl acetate/acrylate copolymers (which may also have up to about 5% of one or more ethylenically unsaturated mono- or dicarboxylic acid monomers added thereto) and all-acrylate copolymer latices.

Several rheological properties of water base latices, such as those described above, are of particular importance when they are to be applied to the formulation of binders for cellulosic materials. For example, in many cases, control of latex particle size and particle size distribution is critical to the realization of desirable physical properties in the finished latex. Further, control of latex viscosity is an important factor due to its influence on polymer distribution, filler loading, and fiber wetting. While all of the polymer systems listed above may be polymerized using conventional emulsion polymerization techniques, this is frequently done in the presence of an added seed polymer to optimize these factors. In addition, while such latices may have either a unimodal or polymodal particle distribution, they are typically unimodal with a particle size in the range between about 100 and 400 nm, a viscosity in the range between 20 and 2000 CPS, and a solids content in the range of 25% and 65%. To impart the fast-curing properties needed for cellulose binder compositions, the latices may be formulated with an amount of a cross-linker or other reactive monomer being added during the formulation thereof. The most effective prior art cross-linkers commonly used with these latices are all known formaldehyde emitters, such as methoxymethyl melamine, N-methylolacrylamide, and glyoxal bisacrylamide.

In yet another aspect of the present invention, it has been found that in the production of these latexes, these formaldehyde emitting cross-linking materials can be entirely replaced with between about ½% and about 15%, by weight, of one or more low or non-formaldehyde emitting, polymerizable reactive monomers, selected from methyl acryloamidoglycolate methyl, ether (MAGME) and isobutoxymethyl acrylamide (IBMA). Such monomers have been found to be especially effective in producing fast-curing, zero formaldehyde latex carriers. It has been found that latices so formulated, when combined with the solution polymers of this invention, form finished binder compositions having wet tensile strengths substantially equivalent or superior to those of prior art cellulose formaldehyde emitting binders. Further, this replacement has also been unexpectedly found to be especially advantageous in producing binder compositions which, when cured, retain their wet strength for significantly longer periods of time, as compared to the binder compositions of the prior art. For example, after being kept moist for a period of 8 days at 67° C., cured test strips treated with a binder of the present invention retained about 20% of their initial wet strength, while those treated with a widely used prior art formaldehyde emitting binder retained only about 12%. (See Comparative Example 3 below).

When MAGME is used as a reactive monomer, the use of longer, lower temperature polymerization (i.e., 6 hours at 65° C. followed by 5 hours at 75° C., as compared to a more commonly used 6 hours at 75° C. followed by 3 hours at 90° C.) is preferred to produce the finished latex carrier. When this is done, it is found that about 5% improvement is evident in the cured wet tensile strength obtained in the finished binder (See Example 4 below).

Formation of the final binder composition is accomplished by admixing one of the above described zero formaldehyde latex carrier latices with between about 2% to about 30%, and more preferably from about 3% to about 15%, and most preferably from about 5% to about 12%, by weight, of either embodiment of the solution copolymers of the present invention, as defined herein above. This is normally followed by diluting said admixture with sufficient deionized water to produce a total nonvolatile solids level between about 3% and about 20% and preferably between about 8% and about 15%. Depending on the particular application involved, other solids levels may be equally effective. When this is done, a binder composition according to the present invention is produced. When cured at about 190° C. for between 4 and 8 seconds on a nonwoven cellulosic material, such compositions will have wet tensile strengths which are as much as 50% higher than those obtainable with the basic carrier latex alone.

In determining the residual formaldehyde content in the cured binder, it has been found that a critical aspect of such assessment is the method by which the measurement is made In a widely used analytical method (the Nash/Hantzsch method), the high reactivity of the formaldehyde molecule with acetylacetone and ammonium carbonate is used to form highly colored diacetyllutedine, which is quantifiable by spectrophotometric methods. (See Nash, Biochem. J., Vol. 55, pages 416–421 (1953)). However, more recent work has shown that this method is not entirely specific to formaldehyde and will react with other materials such as acetaldehyde, IBMA, and MAGME to produce colored reactants which are often incorrectly reported as being formaldehyde. In the studies leading to the present invention, such a problem was avoided by the use of a modified polarographic method which was found to be highly specific to formaldehyde (See Larson, G., "The Electrochemical Determination of Formaldehyde in Monomers, SBR Emulsions and Nonwoven Products", Proceedings of the 1988 TAPPI Nonwovens Conference). All of the formaldehyde levels reported herein are based on the use of this method.

A second factor typifying these latices is that many of those provided commercially have pH values as low as about 2.0. Similarly, when the solution copolymeric reaction is completed, the final aqueous solution will also normally have a pH in the range between about 2.0 to 3.0. While a blended composition having such a level of acidity will produce some degree of cellulosic wet strength, it has been found that neutralizing this acidity with a base, such as sodium hydroxide or, preferably, with ammonium hydroxide to a value of between about 4.0 and 10.0, will produce final binder compositions having considerably improved wet strength.

The invention is further described by the following examples which are illustrative of specific modes of practicing the invention and are not intended as limiting the scope of the invention as defined in the claims. All percentages are by weight unless otherwise specified.

EXAMPLES

EXAMPLE 1

A mixture comprised of 67 grams each of 2-hydroxyethyl acrylate, itaconic acid, and acrylamide, and about 1154 cc of deionized water, was heated to a temperature of about 75° C., after which a solution of an initiator, comprised of 2 grams of sodium persulfate dissolved in about 10 cc of deionized water, was added. This mixture was then heated at 75° C. for 3 hours, after which the resultant copolymer was neutralized to a pH of about 4.0 to 5.0 with concentrated ammonium hydroxide. After cooling and filtering, about 3%, by weight, of the resulting solution copolymer was admixed with a "standard" commercial non-formaldehyde emitting carboxylated SBR copolymer latex comprised of about 57% styrene, 38% butadiene, 3% acrylic acid, and 2% itaconic acid, the admixture then being neutralized with concentrated ammonia to a pH of about 8.0 and diluted with deionized water to achieve a nonvolatile solids content of about 12%. To determine wet strength improvement, two sets of 1"-wide, nonwoven, randomly-oriented cellulose strips were then impregnated with the unadmixed carrier latex and with the binder composition as described above and, after being cured at about 200° C. for 4, 6, 8, 10, 15, and 25 seconds, were dipped in a 1% surfactant solution, after which the wet tensile strength was measured with the following results:

| | Wet Tensile Strength (PSI) Cure time: | | | | | |
|---|---|---|---|---|---|---|
| Binder | 4 sec | 6 sec | 8 sec | 10 sec | 15 sec | 25 sec |
| Standard SBR + 0% solution polymer | 4.8 | 6.8 | 8.2 | 8.4 | 9.6 | 9.7 |
| Standard SBR + 3% solution polymer | 6.0 | 9.6 | 9.4 | 10.1 | 10.3 | 11.2 |

Note that while both compositions achieved 8-second wet strengths of over 80% of the 25-second value, the 25-second wet tensile strength achieved by the "3%" binder was almost 15% higher than that shown by the basic SBR carrier latex alone.

COMPARATIVE EXAMPLE 1

The formaldehyde content and 6- and 180-second wet tensile strengths achieved with a widely used reference commercial cellulose binder composition comprising a carboxylated SBR latex (53.5% butadiene, 43.5% styrene, 2% N-methylol acrylamide, and ½% each of acrylamide and itaconic acid) cross-linked with 6% methoxymethyl melamine (Cymel 303, supplied by The American Cyanamid Co.), a known formaldehyde emitter, were compared to the values obtained with samples of both a vinyl acetate/acrylate latex, copolymerized with and without nominal "10%" isobutoxymethyl acrylamide (IBMA), and a SBR copolymer latex, copolymerized with and without nominal "10%" MAGME, with the following results:

| | Wet Tensile Strength (PSI) | | Formaldehyde |
|---|---|---|---|
| Binder | 6 sec (@ 188° C.) | 180 sec (@ 149° C.) | Content ppm |
| "Reference" SBR + 6% Cymel 303 | 7.9 | 7.9 | 480 |
| Vinyl latex + 0% IBMA | 1.8 | 4.8 | <10 |
| Vinyl latex + 10% IBMA | 5.5 | 6.7 | <10 |
| SBR latex + 0% MAGME | 2.6 | 5.7 | <10 |
| SBR latex + 10% MAGME | 6.7 | 7.0 | <10 |

This is an example of a binder with components (a), (b), and (c) of the present invention forming the solution polymer, the results of which are seen in the bottom 4 rows of the above table. Note that the compositions formulated according to the present invention are listed as exhibiting formaldehyde contents below 10 ppm, after curing. As a practical matter, this means that, in these compositions, formaldehyde was essentially undetectable.

EXAMPLE 2

The procedure of Example 1 was followed but with the solution polymer being formed with 200 grams of a 1:3 mixture of itaconic acid and acrylamide, respectively, dissolved in 1127 grams of deionized water, said mixture being reacted with 1% (2.0 grams) of sodium persulfate dissolved in 18 grams of deionized water at 75° C. for about 3 hours. The reaction product was a copolymer solution having a viscosity of 107 CPS, a total solids content of about 15.6 and a pH of 4.1 after adjustment with ammonium hydroxide. 7.7 grams (wet) of this product was admixed with 49.5 grams (wet) of a base SBR polymer latex comprised of 57.6% styrene, 32.4% butadiene, 9% MAGME and 1% itaconic acid and diluted with sufficient deionized water to achieve a binder composition having a nonvolatile solids content of about 12%. A nonwoven cellulosic material was then impregnated with the so diluted composition to obtain about a 10% add-on, by dry weight. This material, after curing the binder at about 190° C., was tested as described in Example 1, with the following results:

| | Wet Tensile Strength (PSI) | | | |
|---|---|---|---|---|
| Binder | 4 sec (@ 190° C.) | 6 sec (@ 190° C.) | 8 sec (@ 190° C.) | 180 sec (@ 149° C.) |
| Base SBR + 0% solution polymer | 6.1 | 6.8 | 7.3 | 7.1 |
| Base SBR + 10% solution polymer | 6.0 | 7.6 | 8.6 | 8.9 |

EXAMPLE 3

The procedure of Example 2 was followed but with 200 grams of a 1:1 mixture of itaconic acid and acrylamide being used. The final reaction product had a solution viscosity of 22 CPS and a solids content of 15.4%. The solution was then adjusted to a pH of 3.9 with ammonium hydroxide and, after being admixed and cured as described in Example 2, was tested as therein described. The results achieved were as follows:

| Binder | Wet Tensile Strength (PSI) 4 sec (@ 190° C.) | 6 sec | 8 sec | 180 sec (@ 149° C.) |
|---|---|---|---|---|
| Base SBR + 0% solution polymer | 6.1 | 6.8 | 7.3 | 7.1 |
| Base SBR + 10% solution polymer | 5.5 | 8.9 | 9.2 | 9.5 |

Examples 2 and 3 illustrate (in the bottom row of the above tables) the results achieved with a solution polymer containing only compounds (a) and (b).

COMPARATIVE EXAMPLE 2

The procedure of Comparative Example 1 was repeated with the binders of Examples 2 and 3 of the present invention being compared to the "Reference" formaldehyde emitting composition described therein, with the following test results:

| Binder | Wet Tensile Strength (PSI) 6 sec (@ 190° C.) | 180 sec (@ 150° C.) | Formaldehyde Content (ppm) |
|---|---|---|---|
| "Reference" SBR + 6% Cymel 303 | 7.9 | 7.9 | 480 |
| Example 2 binder | 6.5 | 7.9 | <10 |
| Example 3 binder | 7.5 | 8.0 | <10 |

Note that with both compositions of the present invention, the binder with a 10% addition of solution polymer achieved wet strength results at least equal to the reference formaldehyde-emitting binder.

COMPARATIVE EXAMPLE 3

The procedure of Comparative Example 1 was repeated with the finished binder compositions being soaked in a 1% solution of Aerosol OT for 8 days and showing the following results:

| Binder | Wet Tensile Strength (PSI) After 6 sec | After 8 days |
|---|---|---|
| "Reference" SBR + 6% Cymel 303 | 7.9 | 1.0 |
| SBR latex + 5% MAGME | 5.1 | 0.7 |
| SBR latex + 5% MAGME and 5% solution polymer (the invention) | 6.5 | 1.3 |

Note that the residual wet strength of the binder of the present invention was 30% higher, after 8 days, than that of the reference formaldehyde emitting binder.

EXAMPLE 4

A first copolymeric latex comprised of a mixture of 64% styrene, 35% butadiene and 1% itaconic acid and about 1% of a polystyrene seed polymer, with about 5% MAGME added thereto, was prepared at a temperature of about 74° C. The wet tensile strength results obtained were compared to those obtained with a second copolymeric latex comprised of 57% styrene, 38% butadiene, 2% itaconic acid and 3% acrylic acid with 0% MAGME being added thereto and reacted at about 79° C., after both latices were admixed with 10% of the solution polymer of Example 1, neutralized with concentrated ammonium hydroxide to a pH of about 4.0 and diluted with deionized water to achieve a total nonvolatile solids content of about 12%. The results were as follows:

| | Wet Tensile Strength (PSI) 4 sec | 6 sec | 8 sec | 180 sec |
|---|---|---|---|---|
| SBR + 0% MAGME | 3.4 | 4.8 | 5.8 | 8.0 |
| SBR + 5% MAGME | 6.9 | 7.4 | 7.7 | 9.2 |

This shows that a compounded binder comprising a latex carrier which had been polymerized at a low temperature with 5% MAGME can achieve superior wet strength as compared to a basically similar composition comprised of a latex polymerized even at a slightly higher temperature without MAGME.

This invention may be embodied in other forms without departing from the spirit or essential characteristics thereof. For example, it is recognized that while the description of the present invention and the preferred embodiments thereof are all directed toward non-formaldehyde emitting binders, there are applications wherein such a capability is not of concern and that the use of one or more formaldehyde emitting cross-linkers, and/or other constituents may be necessary or desirable in the final binder composition. Consequently, the present embodiments and examples are to be considered only as being illustrative and not restrictive, with the scope of the invention being indicated by the appended claims. All embodiments which come within the scope and equivalency of the claims are, therefore, intended to be embraced therein.

We claim:

1. A fast curing zero-formaldehyde binder for non-woven cellulosic materials, said binder comprising a solution copolymer formed by the copolymerization in aqueous solution of a mixture comprising a first water-soluble comonomer selected from the group consisting of tetrahydrophthalic acid, the cis- and trans- forms of butenedioic acid, methylenesuccinic acid, the diacids resulting when one or more of the hydrogen atoms on the carbon chains of butenedioic acid or methylenesuccinic acid is replaced with ethyl or methyl groups, the $C_1$ to $C_5$ semi-esters of the cis-and trans- forms of butenedioic acid and methylenesuccinic acid, and mixtures thereof; and a second water-soluble comonomer comprised of one or more amides of olefinically unsaturated carboxylic acids, said amides having the general formula:

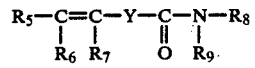

wherein $R_5$, $R_6$, and $R_7$ are independently selected from hydrogen halogen, nitro, amino, and organic radicals; $R_8$ and $R_9$ are selected from hydrogen and organic radicals; and Y is an organic radical or a covalent bond; with said solution copolymer being admixed in an amount between about 2 percent and about 20 percent, by weight, with a non-formaldehyde emitting latex carrier to produce said binder, said latex carrier being formulated with between about 0.5 percent and about 15 percent, by weight, of a substantially non-formaldehyde emitting reactive monomer selected from the group consisting of methylacryloamido glycolate—methyl ether and isobutoxymethyl acrylamide.

2. The binder of claim 1 wherein said first comonomer is selected from maleic acid and itaconic acid and said second comonomer is acrylamide.

3. The binder of claim 1 wherein said solution copolymer further comprises a third water-soluble comonomer comprised of one or more hydroxyalkyl esters of olefinically unsaturated carboxylic acids, said esters having the general formula:

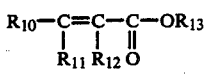

wherein $R_{10}$, $R_{11}$, and $R_{12}$ are independently selected from hydrogen, methyl and ethyl radicals; and $R_{13}$ is an organic radical having from 2 to about 4 carbon atoms, and containing a hydroxyl substituent located on a carbon atom which is at least 2 carbon atoms away from the carboxylate group shown in the above formula.

4. The binder of claim 3 wherein said first comonomer is selected from maleic acid and itaconic acid, said second comonomer is acrylamide and said third comonomer is 2-hydroxyethyl acrylate.

5. A fast-curing, zero formaldehyde binder for nonwoven cellulosic materials, said binder comprising a solution copolymer formed by the copolymerization in aqueous solution of a mixture comprising one part of a first water-soluble comonomer selected from the group consisting of tetrahydrophthalic acid, the cis- and transforms of butenedioic acid, methylenesuccinic acid, the diacids resulting when one or more of the hydrogen atoms on the carbon chains of butenedioic acid or methylenesuccinic acid is replaced with ethyl or methyl groups, the $C_1$ to $C_5$ semi-esters of the cis- and transforms of butenedioic acid and methylene succinic acid, and mixtures thereof; and between 0.1and 9 parts, by weight, of a second water-soluble comonomer selected from the group consisting of one or more of the primary amides of acrylic acid or methacrylic acid and the methyl and ethyl substituted secondary amides of acrylic acid or methacrylic acid; said solution copolymer being admixed with a non-formaldehyde emitting latex selected from styrene-butadiene copolymer, carboxylated styrene-butadiene copolymer, vinyl acetate/acrylate copolymer and all-acrylate polymer latices, in an amount of between about 3 percent and about 15 percent, by weight, based on said latex, to produce said binder, said latex being formulated with between about 0.5 percent and about 15 percent, by weight, of a substantially non-formaldehyde emitting reactive monomer selected from the group consisting of methylacryloamido glycolate—methyl ether and isobutoxy-methyl acrylamide.

6. The binder of claim 5 wherein said solution polymer mixture further comprises up to about 20%, by weight, of one or more polymerizable, monoethylenically unsaturated nonionic monomers selected from the group consisting of $C_1$ to $C_5$ saturated esters of acrylic and methacrylic acid, vinyl acetate, vinyl chloride, styrene and vinylidene chloride.

7. The binder of claim 5 wherein said admixed latex is diluted with water to achieve a total amount of nonvolatile solids in said latex between about 3% and about 20%.

8. The binder of claim 5 wherein said binder comprises a solution copolymer formed by the reaction mixture of a first water-soluble comonomer selected from maleic acid and itaconic acid with acrylamide, in an amount between about 0.5 part and about 4.0 parts, by weight, of acrylamide, for each part of said first comonomer and from 0.1% to about 2%, by weight, of a second mixture comprised of equal parts of ethyl acrylate and styrene, to produce a solution copolymer which is admixed in an amount between about 3% and about 10%, by weight, with a non-formaldehyde emitting carboxylated SBR latex carrier, the resulting admixture further being diluted with sufficient water to produce a non-volatile solids content of between 8% and 15% in said binder.

9. A fast-curing, zero formaldehyde binder for nonwoven cellulosic materials, said binder comprising a solution copolymer formed by the copolymerization in aqueous solution of a mixture comprising a first water-soluble comonomer selected from maleic acid and itaconic acid; a second water-soluble comonomer selected from the group consisting of one or more of the primary amides of acrylic acid or methacrylic acid and the methyl and ethyl substituted secondary amides of acrylic acid or methacrylic acid; and a third water-soluble comonomer selected from the group consisting of one or more $C_2$ to $C_4$ hydroxyalkyl esters of acrylic acid or methacrylic acid, said second and third comonomers being separately present in amounts between about 0.1 part and about 9.0 parts, by weight, for each part of said first comonomer, said solution copolymer being admixed in an amount between about 3 percent and about 15 percent, by weight, with a non-formaldehyde emitting latex carrier selected from styrene-butadiene copolymer, carboxylated styrene-butadiene copolymer, vinyl acetate/acrylate copolymer and all-acrylate polymer latices, said latices being formulated with between about 0.5 percent and about 15 percent, by weight, of a substantially non-formaldehyde forming reactive monomer selected from the group consisting of methylacryloamido glycolate—methyl ether and isobutoxymethyl acrylamide.

10. The binder of claim 9 comprising a solution copolymer formed by the copolymerization in aqueous solution of a mixture comprising a first water-soluble comonomer selected from maleic acid, itaconic acid and mixtures thereof, and about 0.5 part and about 4.0 parts, by weight, each of acrylamide and 2-hydroxyethyl acrylate per part of said first comonomer and from 0.1 percent to about 2 percent, by weight of total monomers, of a mixture comprised of ethyl acrylate and styrene, to produce a solution copolymer; said solution copolymer being admixed in an amount between about 3 percent and about 10 percent, by weight, with a non-formaldehyde emitting a carboxylated SBR latex carrier, the resulting admixture further being diluted with sufficient water to produce a non-volatile solids content of between 8 percent and 15 percent in said binder.

11. The binder of claim 9 wherein said solution polymer mixture further comprises up to about 20%, by weight, of 1 or more polymerizable, monoethylenically unsaturated nonionic monomers selected from the class consisting of $C_1$ to $C_5$ saturated esters of acrylic and methacrylic acid, vinyl acetate, vinyl chloride, styrene and vinylidene chloride.

12. The binder of claim 11 wherein the resulting admixture of said solution polymer and said latex is diluted with water to achieve a non-volatile solids content between about 3% and about 20%.

13. A process for preparing a fast-curing, zero formaldehyde binder for nonwoven cellulosic materials, comprising:

(a) copolymerizing in aqueous solution a mixture comprising a first water-soluble comonomer selected from the group consisting of tetrahydrophthalic acid, the cis- and trans- forms of butenedioic acid, methylenesuccinic acid, the diacids resulting when one or more of the hydrogen atoms on the carbon chains of butenedioic acid or methylenesuccinic acid is replaced with ethyl or methyl groups, the $C_1$ to $C_5$ semi-esters of the cis- and trans- forms of butenedioic acid and methylenesuccinic acid, and mixtures thereof; and a second water-soluble comonomer comprised of one or more amides of olefinically unsaturated carboxylic acids, said amides having the general formula:

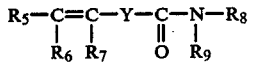

wherein $R_5$, $R_6$ and $R_7$ are independently selected from hydrogen, halogen, nitro, amino, and organic radicals; $R_8$ and $R_9$ are selected from hydrogen and organic radicals; and Y is an organic radical or a covalent bond; said copolymerization being carried out with between about 0.5 part and about 4 parts, by weight, of said second comonomer for each part of said first comonomer to produce a solution copolymer; and (b) admixing, in an amount between about 2 percent and about 20 percent, by weight, said solution copolymer with a non-formaldehyde emitting latex carrier formulated with between about 2 percent and about 15 percent, by weight of a substantially non-formaldehyde forming reactive monomer selected from the group consisting of methylacryloamido glycolate—methyl ether and isobutoxymethyl acrylamide.

14. The process of claim 13 wherein said first comonomer is selected from maleic acid and itaconic acid and said second comonomer is acrylamide.

15. The process of claim 13 wherein the comonomeric mixture of step (a) further comprises between 0.5 and 4.0 parts, by weight, of a third water-soluble comonomer comprised of one or more hydroxyalkyl esters of olefinically unsaturated carboxylic acids, said esters having the general formula:

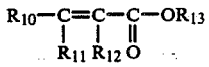

wherein $R_{10}$, $R_{11}$, and $R_{12}$ are independently selected from hydrogen, methyl and ethyl radicals; and $R_{13}$ is an organic radical having from 2 to about 4 carbon atoms and containing a hydroxyl substituent located on a carbon atom which is at least 2 carbon atoms away from the carboxylate group shows in the above formula.

16. The process of claim 15 wherein said first comonomer is selected from maleic acid and itaconic acid, said second comonomer is acrylamide and said third comonomer is 2-hydroxyethyl acrylate.

* * * * *